US008069769B2

(12) United States Patent
Carberry et al.

(10) Patent No.: US 8,069,769 B2
(45) Date of Patent: Dec. 6, 2011

(54) PORTABLE PROTECTION DEVICE

(75) Inventors: John Carberry, Talbott, TN (US); George D. Forsythe, Landenberg, PA (US); Harvey Kliman, Hamilton, NY (US); Katherine T. Leighton, Newark, DE (US); John Garnier, Newark, DE (US); Ray Ballario, Prospect Park, PA (US); Wiktor Serafin, Boothwyn, PA (US); Jason Ickes, Secane, PA (US)

(73) Assignee: Dynamic Defense Materials, LLC, Marlton, NJ (US)

( * ) Notice: Subject to any disclaimer, the term of this patent is extended or adjusted under 35 U.S.C. 154(b) by 77 days.

(21) Appl. No.: 12/257,902

(22) Filed: Oct. 24, 2008

(65) Prior Publication Data

US 2010/0043629 A1 Feb. 25, 2010

Related U.S. Application Data

(63) Continuation-in-part of application No. 11/113,149, filed on Apr. 25, 2005, now abandoned.

(51) Int. Cl.
*F41H 5/04* (2006.01)

(52) U.S. Cl. ..... 89/36.02; 89/36.04; 89/920; 109/49.5

(58) Field of Classification Search ..... 52/70, 71, 52/645, 646, 648.1, 582.1, 582.2; 89/36.02, 89/36.04, 920, 36.05, 36.07; 109/1 R, 1 S, 109/49.5; 428/12

See application file for complete search history.

(56) References Cited

U.S. PATENT DOCUMENTS 377,732 A * 2/1888 Adams ..... 2/2.5
660,478 A 10/1900 Wells
1,279,571 A 9/1918 Moloney
2,316,055 A 7/1939 Davey
3,462,181 A 8/1969 Lewis
3,745,938 A * 7/1973 Hathaway et al. ..... 109/49.5
4,035,964 A * 7/1977 Robinson ..... 52/66
4,198,454 A 4/1980 Norton
4,398,446 A 8/1983 Pagano et al.
4,412,495 A * 11/1983 Sankar ..... 109/49.5
4,442,780 A 4/1984 Child
4,450,937 A * 5/1984 Broughton ..... 182/206
4,455,801 A 6/1984 Merritt
4,483,947 A 11/1984 Bauer et al.
4,529,640 A * 7/1985 Brown et al. ..... 428/116
4,566,237 A 1/1986 Turner
4,580,776 A 4/1986 Burkinshaw
4,683,800 A 8/1987 Snedeker
4,732,803 A * 3/1988 Smith, Jr. ..... 428/212

(Continued)

OTHER PUBLICATIONS

International Search Report for International Application No. PCT/US09/61664; 2 pgs.

(Continued)

*Primary Examiner* — Robert Canfield
*Assistant Examiner* — Babajide Demuren
(74) *Attorney, Agent, or Firm* — Blank Rome LLP

(57) ABSTRACT

A portable protection system including a selectively collapsible truss for supporting a protection member. The truss is movable between a collapsed position and an expanded position. The protection member includes at least one layer of ballistic armor material for disrupting a projectile. The truss includes suitable connectors for releasably connecting the protection member to the truss, and also suitable connectors for releasably connecting the truss to an adjoining truss so as to form a protection wall.

20 Claims, 17 Drawing Sheets

U.S. PATENT DOCUMENTS 4,748,790 A 6/1988 Frangoiacci
4,822,657 A 4/1989 Simpson
4,843,947 A 7/1989 Bauer et al.
4,854,248 A 8/1989 Salzer
4,879,957 A 11/1989 Habicht et al.
4,881,448 A 11/1989 Medin et al.
4,928,468 A 5/1990 Phillips
4,962,710 A 10/1990 Habicht et al.
4,970,841 A 11/1990 Zeigler
5,142,997 A 9/1992 DeLong et al.
5,200,256 A * 4/1993 Dunbar ..... 428/212
5,253,763 A 10/1993 Kirkley et al.
5,269,112 A 12/1993 Weinrub et al.
5,367,852 A 11/1994 Masuda et al.
5,386,788 A 2/1995 Linker et al.
5,392,686 A 2/1995 Sankar
5,441,126 A 8/1995 Orrick
5,576,508 A * 11/1996 Korpi ..... 89/36.01
5,996,115 A 12/1999 Mazelsky
6,170,379 B1 1/2001 Taylor
6,240,939 B1 6/2001 McGee
6,364,057 B1 * 4/2002 Cornejo et al. ..... 182/106
6,401,427 B1 6/2002 Snyder
6,500,507 B1 12/2002 Fisher
6,581,505 B1 6/2003 Levell
6,622,607 B1 9/2003 Miller
6,681,679 B2 1/2004 Vives et al.
6,799,594 B2 10/2004 Kuo
6,807,890 B1 * 10/2004 Fuqua ..... 89/36.02
7,117,644 B2 10/2006 DeHart
7,159,503 B1 1/2007 Weatherwax
7,237,749 B2 7/2007 Ritts et al.
7,296,699 B2 11/2007 Hung et al.
7,302,880 B1 12/2007 Elasic
7,357,238 B2 4/2008 Zeigler
2003/0221547 A1 12/2003 Peretz
2004/0050008 A1 * 3/2004 Mintie et al. ..... 52/646
2004/0177568 A1 9/2004 Hanks
2005/0247004 A1 * 11/2005 Sardi Herrera ..... 52/633
2006/0076188 A1 * 4/2006 Horton ..... 182/106
2006/0201085 A1 9/2006 Dehart
2006/0288856 A1 * 12/2006 Labock ..... 89/36.04
2007/0039639 A1 2/2007 Duncan

OTHER PUBLICATIONS

Written Opinion of the International Searching Authority for International Application No. PCT/US09/61664; 6 pgs.
Search Report for Application No. GB0918606.5; Relevant Document WO2006/116359; 29 pgs.
International Search Report and Written Opinion, International Application No. PCT/US2009/061664; International Filing Date Oct. 22, 2009; 8 pages.

* cited by examiner

PORTABLE PROTECTION DEVICE

CROSS-REFERENCE TO RELATED APPLICATIONS

This application is a continuation-in-part of prior application Ser. No. 11/113,149, filed Apr. 25, 2005.

STATEMENT REGARDING FEDERALLY-SPONSORED RESEARCH OR DEVELOPMENT

Not Applicable

BACKGROUND OF THE INVENTION

1. Field of Invention

The present invention relates to a portable protection system that can be assembled to establish a protective barrier to a threat, such as a ballistic projectile, a blast, or other such threat. More specifically, the present invention relates to a modular portable structure adapted to carry an armor layer to form a protective wall.

2. Description of the Related Art

In military operations and high risk areas for civilian operations, protection of personnel and critical equipment from ballistic projectiles, explosive ordnance, chemical attack, and forces and objects from detonation of improvised explosive devices (collectively hereinafter "projectiles") is critical. In order to provide protection of personnel and equipment from projectiles, it is necessary to provide a means of disbursing the kinetic energy of such projectiles to prevent them from reaching their target. An efficient means of disbursing the kinetic energy of such projectiles is to interpose a shield between the objects and persons to be protected and the incoming threat. Shields fabricated from ballistic material are known to provide at least some protection against projectiles. As used herein, a "ballistic" material is defined as having the property of stopping, or severely retarding the progress of, a projectile. However, it will be understood that a ballistic shield may not be completely impenetrable to all types of projectiles under all situations.

In military operations and other such applications, often it becomes necessary to move personnel, equipment, and the like into an area and establish a defensible position while under the threat of attack from incoming projectiles. In such situations, structures incorporating ballistic shields are often used to protect an area from the incoming projectiles, thereby allowing personnel to seek cover from the incoming projectiles behind the ballistic shield structure. When using conventional ballistic shield structures, such as concrete walls or walls formed from sand bags, a problem arises in that such conventional ballistic shield structures are not easily portable, and assembly of such conventional ballistic shield structures is often slow and labor intensive. As a result, assembly and use of such conventional ballistic shield structures while under the threat of attack from incoming projectiles is often impractical.

Furthermore, in certain applications involving the use of ballistic shield structures, it often becomes necessary for personnel protected by the ballistic shield structure to observe and interact with persons and objects beyond the ballistic shield structure, such as for example, during the interaction of security personnel with persons and vehicles passing a security checkpoint. In such applications, it is often desirable to allow one or more security personnel to remain positioned opposite a ballistic shield structure from persons and objects passing the checkpoint while also allowing the security personnel to observe the persons and objects from the relative safety provided behind the ballistic shield structure. In situations in which the threat of attack from incoming projectiles is imminent, it is often desirable to allow security personnel to remain positioned behind a ballistic shield structure while accessing persons and objects beyond the ballistic shield structure in order to interact with and potentially engage and combat such persons and objects.

Examples of conventional shield systems are disclosed in U.S. Pat. No. 6,681,679 to Vives et al., U.S. Pat. No. 6,807,890 to Fugua, U.S. Pat. No. 6,581,505 to Levell, U.S. Pat. No. 5,386,788 to Linker et al., and U.S. Pat. No. 4,398,446 to Pagano et al., the subject matter of each of which is hereby incorporated by reference. These conventional shield systems are often not readily portable, difficult to assemble, limited in the protection provided, limited to a single set up configuration, support only one type of armor, and are not adjustable to various threat levels or environments. Moreover, these conventional shield systems often do not allow for the observance of and interaction with persons and objects through the conventional shield system.

BRIEF SUMMARY OF THE INVENTION

The foregoing objects are attained by a truss for supporting a protection member that includes first and second opposing frames and a support member disposed between the first and second frames connecting the first and second frames. The support member is selectively movable such that the first and second frames are movable between a collapsed position with the first and second frames being adjacent one another and an expanded position with the first and second frames being laterally spaced from one another. The support member is releasably lockable in the expanded position by a lock.

A holding member is disposed on at least one of the first and second frames for releasably engaging the protection member. The protection member includes a panel fabricated from a protective material, such as for example, a ballistic material. The protection member further includes suitable connectors to engage the holding member, thereby allowing the panel to be releasably secured to the truss. In one embodiment, the panel further includes a window adapted to allow selective access through the panel. In another embodiment, at least one roof protection member is selectively securable to the truss in an overhead configuration, so as to form a roof structure.

A plurality of locator members are disposed on the truss. The locator members are configured to engage and selectively secure the truss to an adjacent truss, thereby allowing multiple trusses to be ganged together to form a protective wall. In one embodiment, a stanchion member is disposed on at least one of the first and second frames for securing the truss to a floor surface, such as the ground. In another embodiment, a container is disposed within the truss for holding a dispersive material such as sand. In still another embodiment, a flexible armor blanket is provided to control fragmentation of a disrupted ballistic projectile.

Other objects, advantages and salient features of the invention will become apparent from the following detailed description, which, taken in conjunction with the annexed drawings, discloses preferred embodiments of the present invention.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
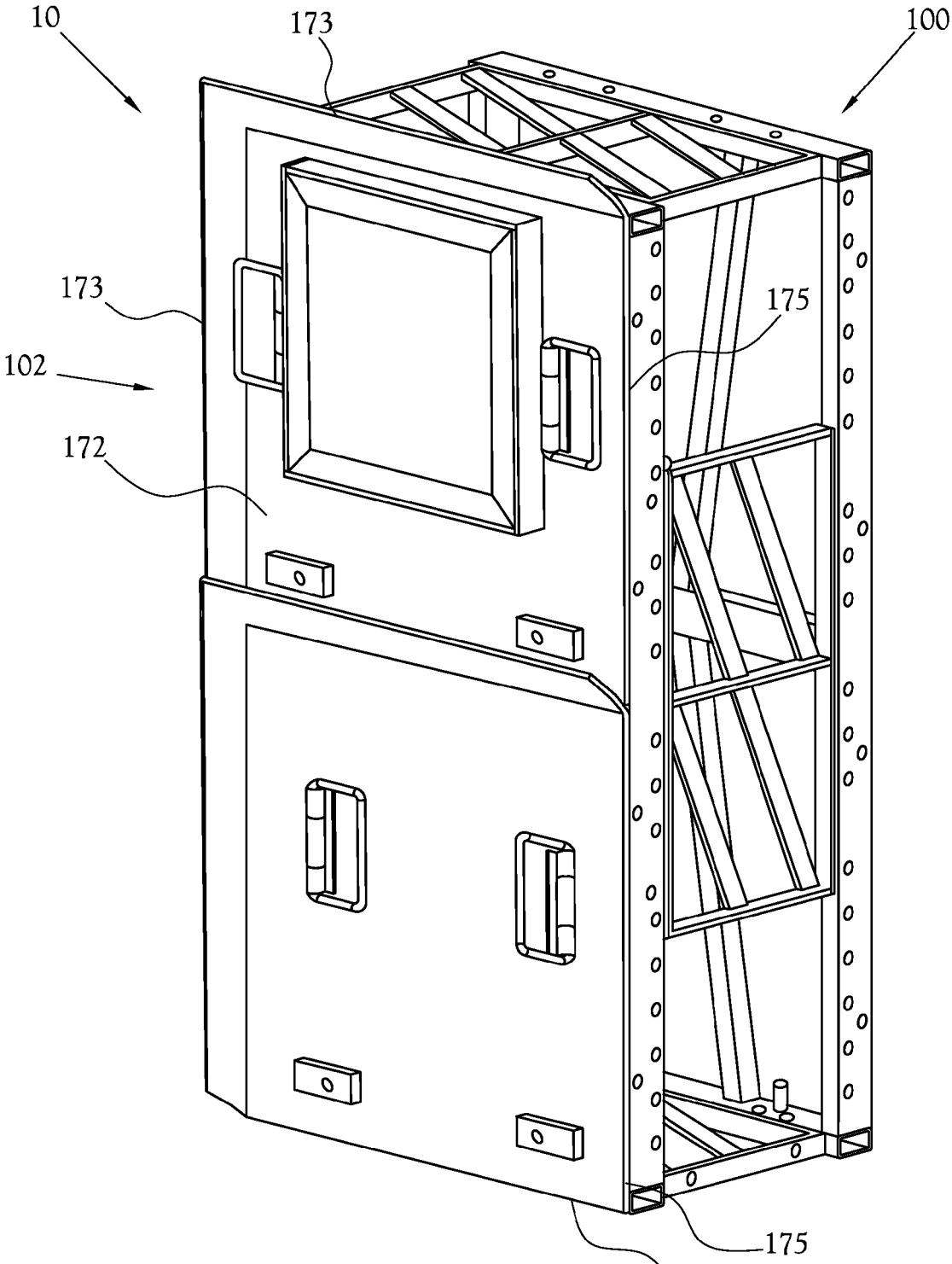
FIG. 1 is a perspective view of one embodiment of the portable protection system.

FIG. 1 illustrates a portable protection system according to one embodiment of the present invention. The portable protection system, or system, is identified as 10 herein and in the accompanying figures. In the illustrated embodiment, the portable protection system 10 includes generally a selectively collapsible and expandable truss 100 which, when configured to an expanded position, is adapted to carry and support at least one protection member 102. The truss 100 is fabricated from a substantially rigid material, such as aluminum, steel, fiber reinforced composite, polymer, or the like. As will be discussed in further detail below, the truss 100 is adapted to be selectively configured between an expanded position and a collapsed position.

Figure 2:
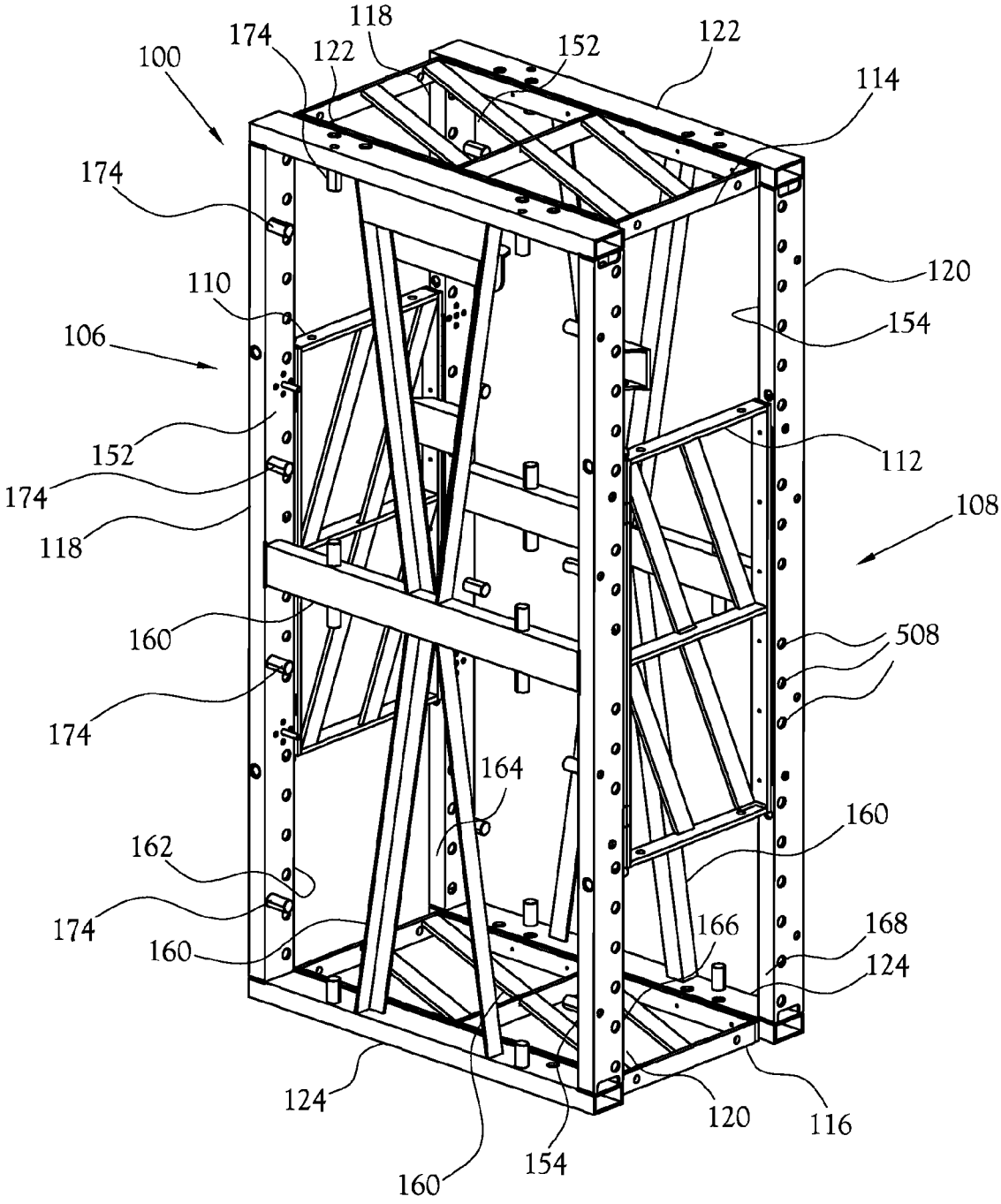
FIG. 2 is a perspective view of one embodiment of a truss of the portable protection system, showing the truss in an expanded position.

FIG. 2 illustrates one embodiment of a truss 100 assembled in the expanded position. Referring to FIG. 2, the truss 100 includes a first wall frame 106 and a second wall frame 108 arranged in a substantially parallel and overlapping configuration. Each wall frame 106, 108 includes first and second side members 118, 120 and first and second end members 122, 124 fixed to and extending between the first and second side members 118, 120 in a substantially coplanar configuration. The first and second side members 118, 120 include first opposing inner surfaces 152, 154. In the illustrated embodiment, a plurality of central braces 160 are provided, with at least one central brace 160 extending between the first opposing inner surfaces 152, 154, thereby dividing each wall frame 106, 108 into two partitions. The first side members 118 of each of the wall frames 106, 108 include second opposing inner surfaces 162, 164 and the second side members 120 of each of the wall frames 106, 108 include third opposing inner surfaces 166, 168.

The first and second wall frames 106, 108 are held in a spaced apart in relation to one another by a plurality of support frames 110, 112, 114, 116. The support frames 110, 112, 114, 116 serve to releasably secure the first and second wall frames 106, 108 in spatial relation to one another so as to provide rigid support to the truss 100 when configured to the expanded position. As seen in FIG. 2, in the illustrated embodiment, four support frames 110, 112, 114, 116 are provided. A first support frame 110 extends between the first side members 118 of the first and second wall frames 106, 108. A second support frame 112 extends between the second side members 120 of the first and second wall frames 106, 108. A third support frame 114, extends between the first end members 122 of the first and second wall frames 106, 108, and a fourth support frame 116, extends between the second end members 124 of the first and second wall frames 106, 108. Those skilled in the art will recognize numerous configurations for the support frames which are suitable for maintaining the first and second wall frames 106, 108 in position proximate one another, and such configurations may be used without departing from the spirit and scope of the present invention.

Figure 3:
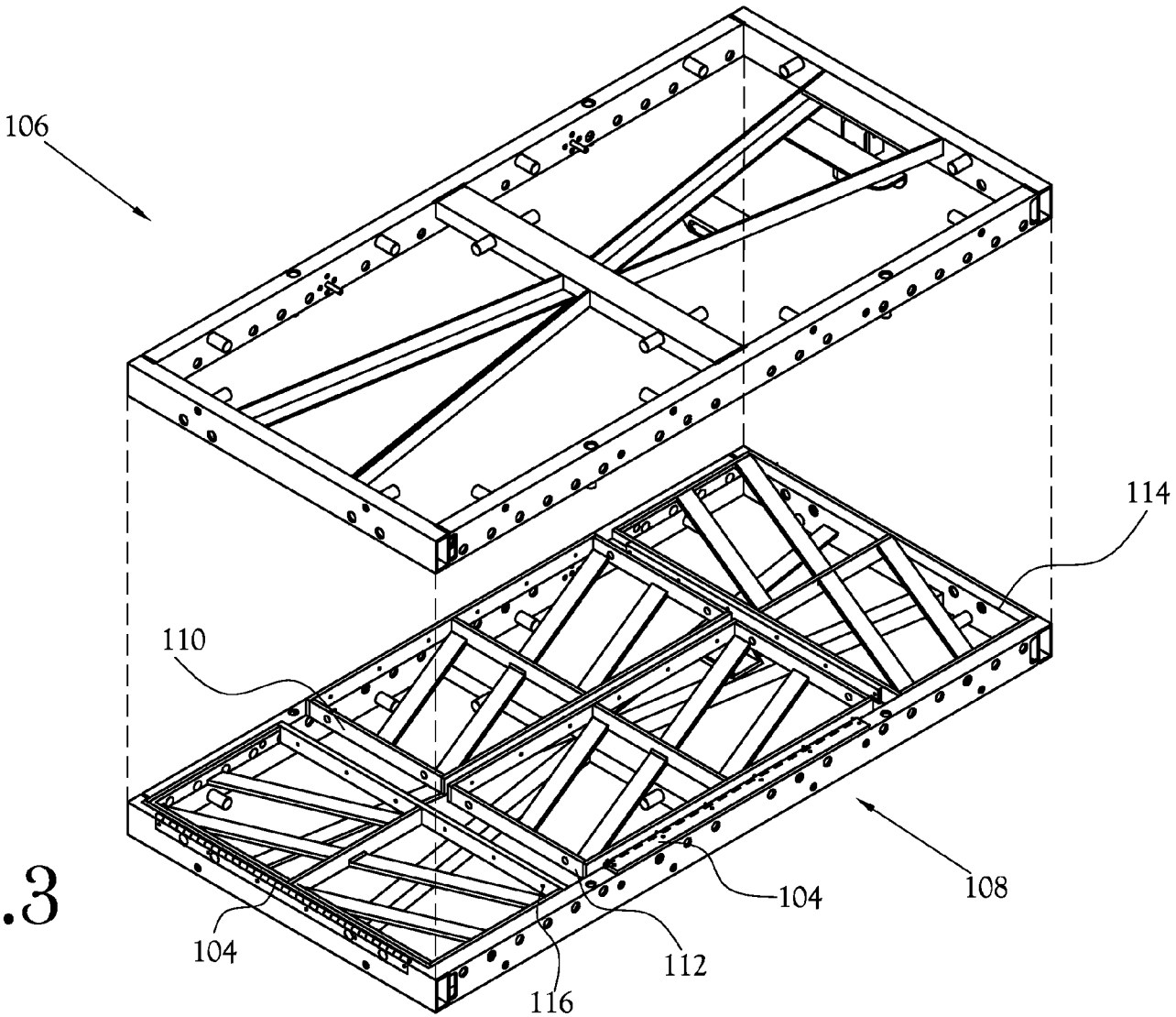
FIG. 3 is a partially exploded perspective view of the truss of FIG. 2, showing the truss in a collapsed position with the first wall frame exploded from the second wall frame.

As mentioned above, the truss 100 is adapted to be selectively collapsed and expanded. In several embodiments, the first and second wall frames 106, 108 are adapted to be selectively repositionable proximate one another between the expanded position and the collapsed position. For example, in the illustrated embodiment, each of the support frames 110, 112, 114, 116 is selectively secured to the first wall frame 106 in the expanded position by a releasable fastener, such as a latch, a hook and loop fastener, a nut and bolt assembly, or other such releasable fastener. As shown in FIG. 3, each of the support frames 110, 112, 114, 116 is rotatably connected to the second wall frame 108 by a hinge 104. In this embodiment, the truss 100 is selectively configured to the collapsed position by releasing the first wall frame 106 from each of the support frames 110, 112, 114, 116. Once the first wall frame 106 is released, each of the support frames 110, 112, 114, 116 is selectively rotated about an adjoining hinge 104 against the second wall frame 108, thereby allowing the first and second wall frames 106, 108 to be selectively stacked in a collapsed position, with each of the support frames 110, 112, 114, 116 disposed in a substantially coplanar configuration therebetween. In another embodiment, each of the support frames 110, 112, 114, 116 is selectively secured to both first and second wall frames 106, 108 in the expanded position by releasable fasteners, such that the truss 100 is selectively collapsable by disconnecting each of the support frames 110, 112, 114, 116 from the wall frames 106, 108 and stacking the various support frames and wall frames.

Figure 4:
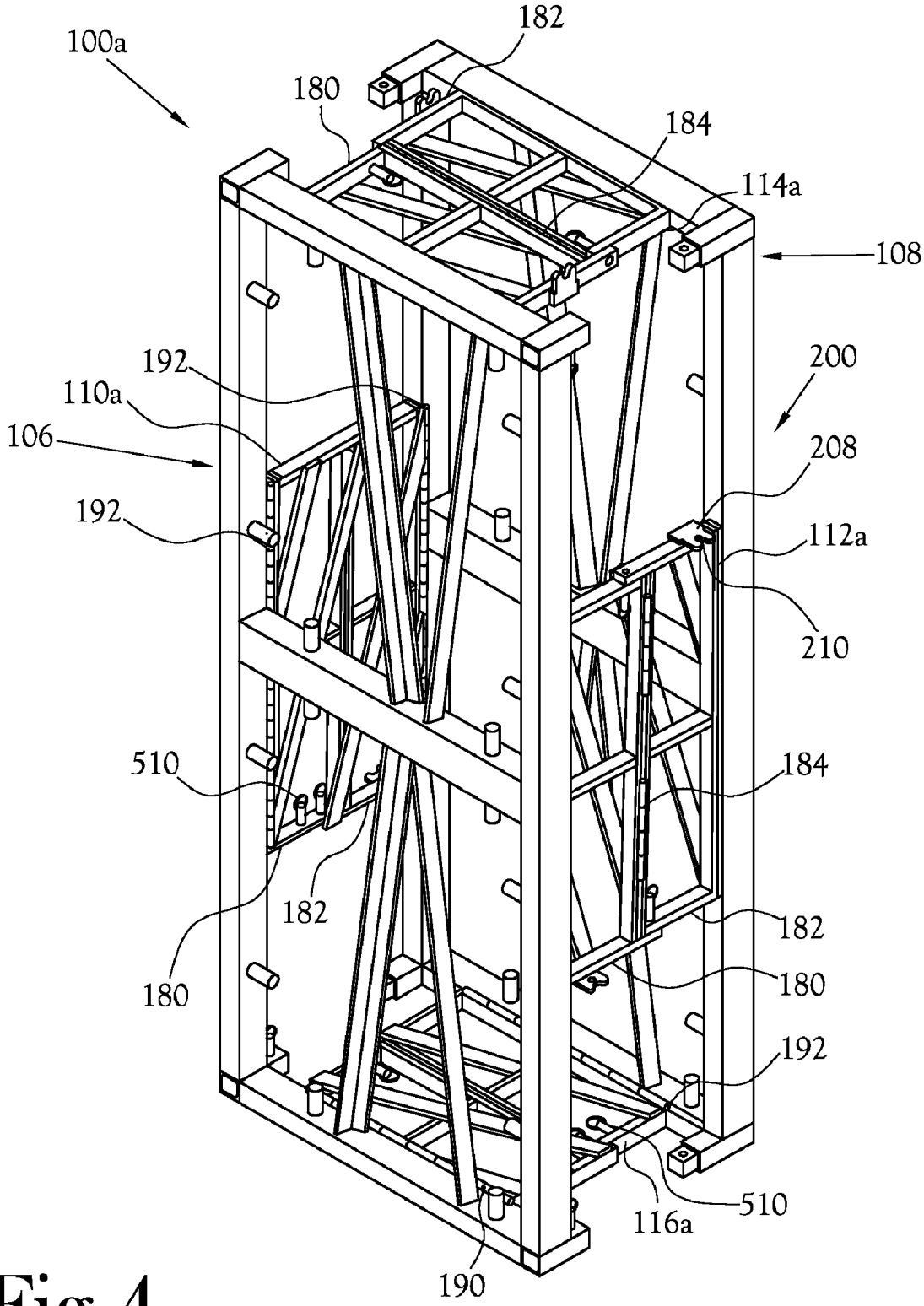
FIG. 4 is a perspective view of the truss portion of another embodiment of the present invention, showing the truss in an expanded position.
Figure 5:
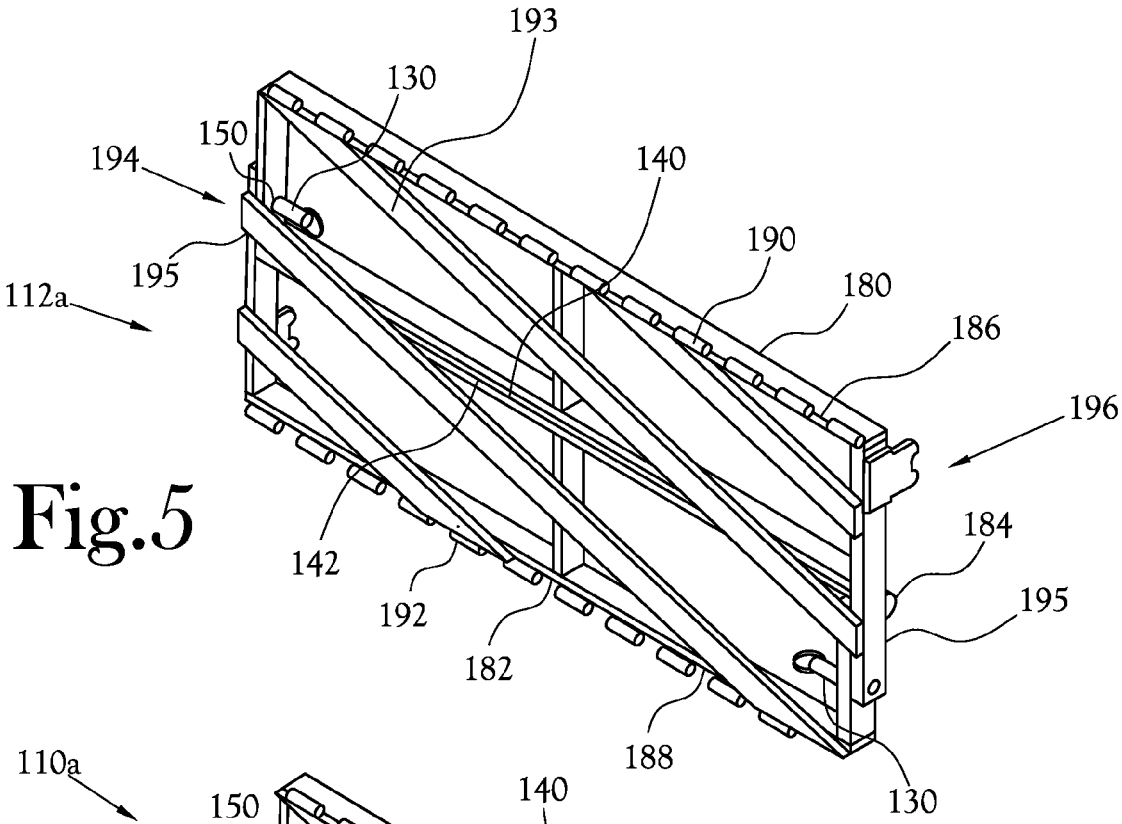
FIG. 5 is a perspective view of an expandable support member of the truss of FIG. 4, showing the expandable support member in an expanded position.
Figure 6:
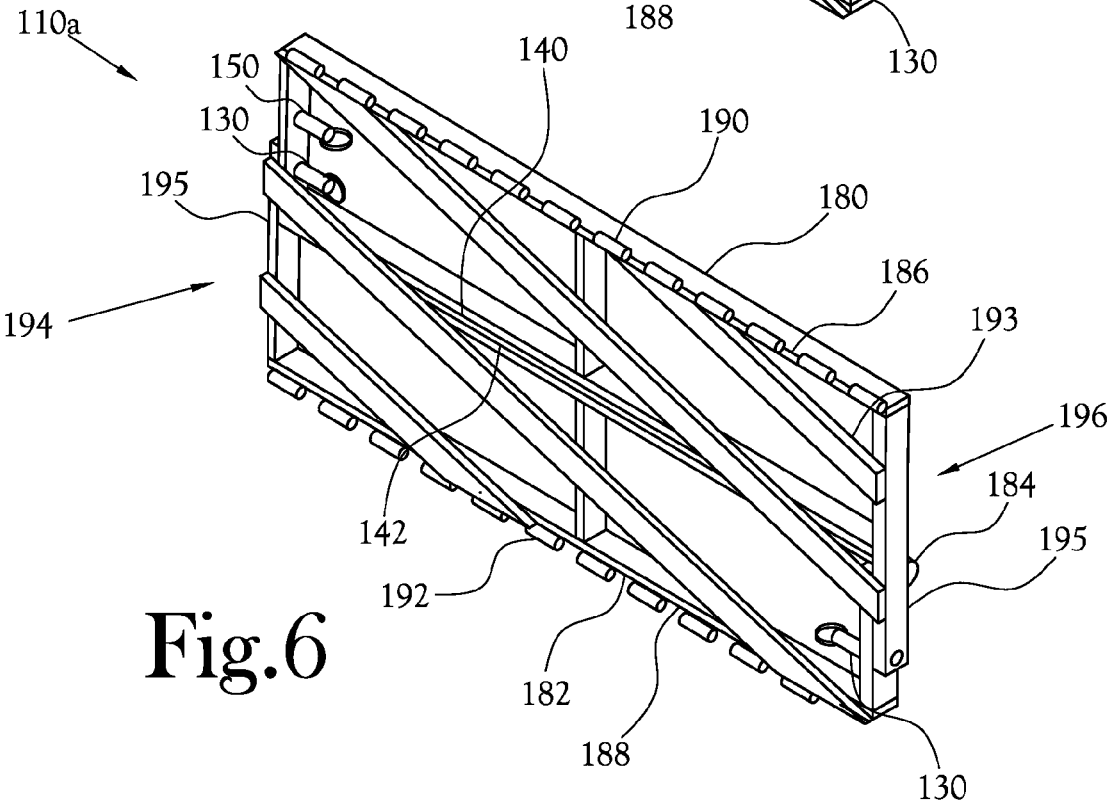
FIG. 6 is a perspective view of another expandable support member of the truss of FIG. 4, showing the expandable support member in an expanded position.
Figure 7:
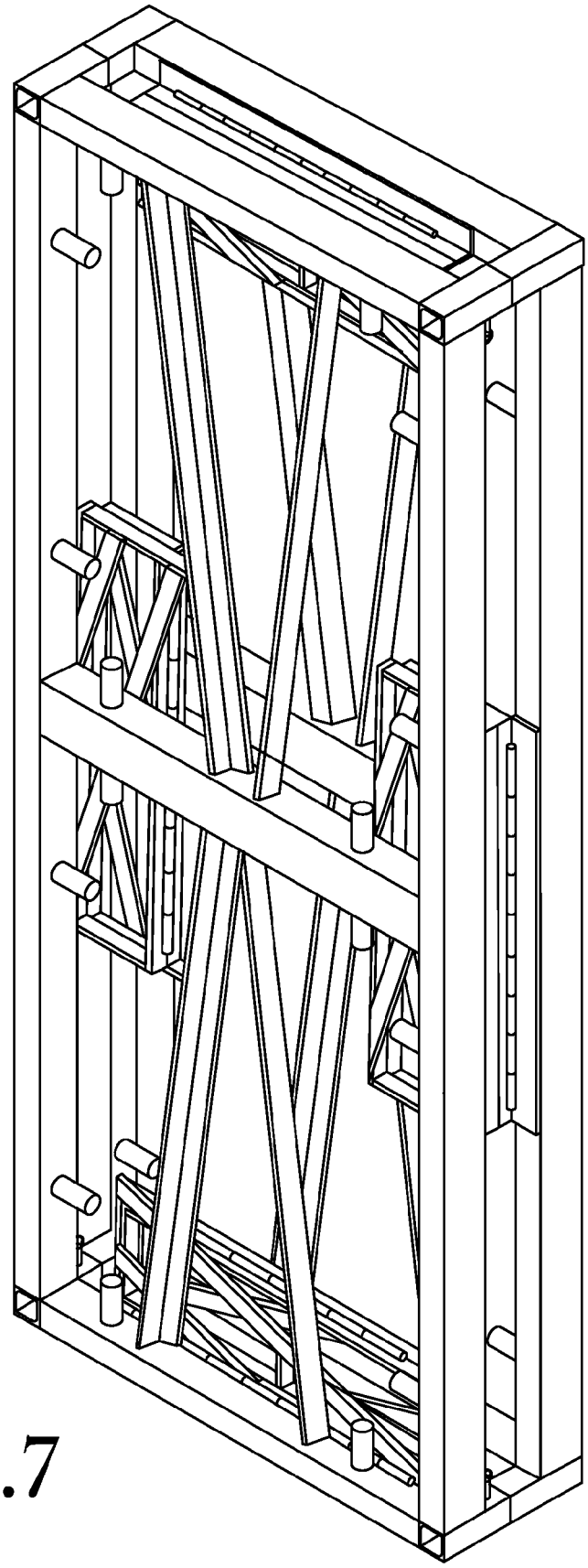
FIG. 7 is a perspective view of the embodiment of the truss of FIG. 4, showing the truss in a collapsed position.
Figure 8:
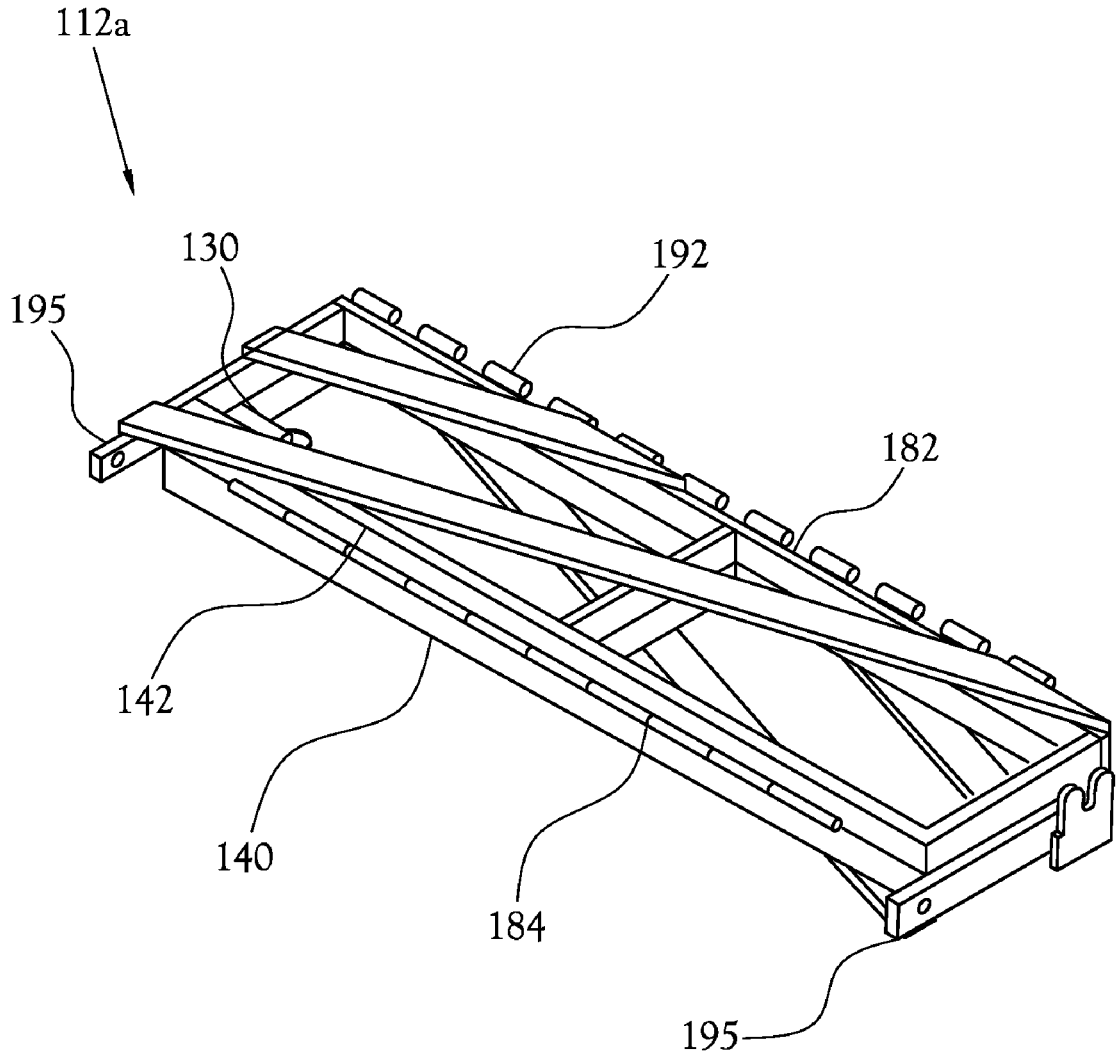
FIG. 8 is a perspective view of an expandable support member of the frame of FIG. 4, showing the expandable support member in a collapsed position.

FIGS. 4-10 illustrate another embodiment of the truss 100*a*. In this embodiment, the truss 100*a* is selectively collapsible and expandable absent the selective disconnection of either of the wall frames 106, 108 from any of the support frames 110*a*, 112*a*, 114*a*, 116*a*. In this embodiment, each support frame 110*a*, 112*a*, 114*a*, 116*a* is defined by an expandable support member. Referring to FIGS. 5 and 6, each support frame 110*a*, 112*a*, 114*a*, 116*a* includes a first gate 180 rotatably connected to a second gate 182 along inner edges 140, 142 of the first and second gates 180, 182 by a first hinge 184. Opposite outer edges 186, 188 of the first and second gates 180, 182 are rotatably connected to the first and second frames 106, 108, by second and third hinges 190, 192, respectively. For each support frame 110*a*, 112*a*, 114*a*, 116*a*, the first gate 180 is rotatable proximate the second gate 182 about the first hinge 184 into a stacked configuration when the truss 100*a* is collapsed (see FIGS. 7 and 8) and into a side-by-side configuration when the truss 100*a* is expanded (see FIGS. 4 and 5).

Figure 9:
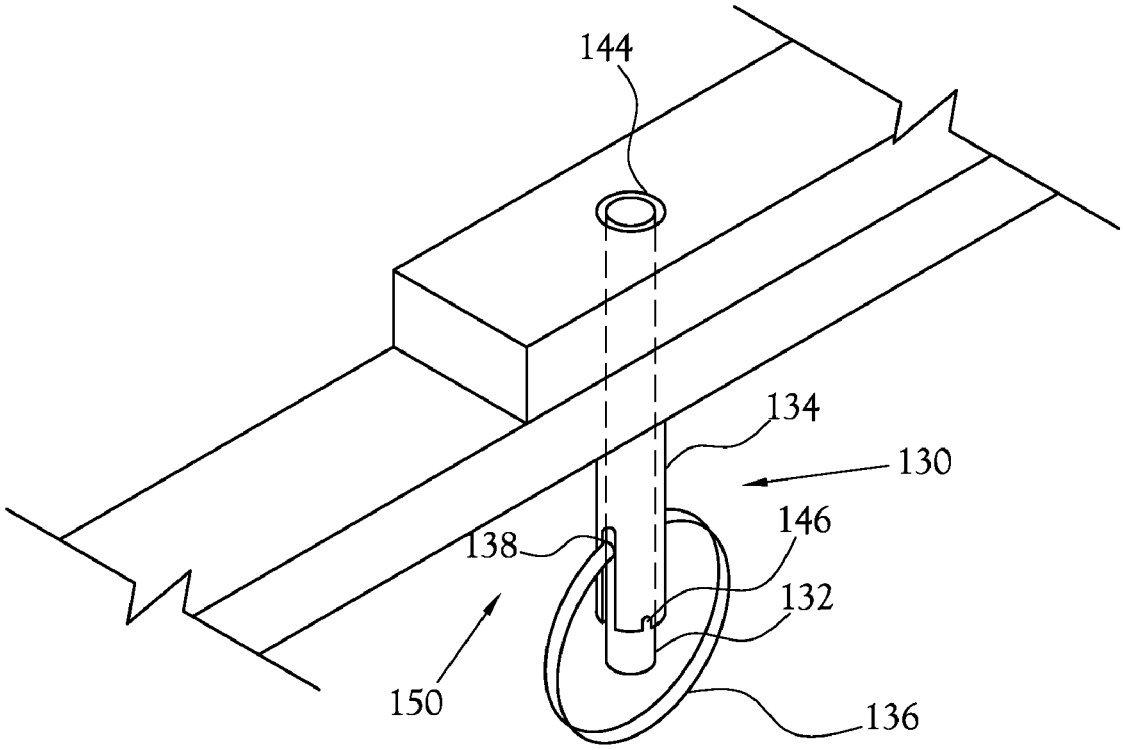
FIG. 9 is an enlarged partial perspective view of an expandable support member and accompanying lock.

Support braces 193 extend between the opposite ends 194, 196 of each gate 180, 182. Each gate 180, 182 defines an overlap extension 195 which engages an adjoining gate when the gates 180, 182 are rotated to the side-by-side expanded position. In the illustrated embodiment, a lock 130 is provided at each opposite end 194, 196 of each gate 180, 182 for engaging the overlap extension 195 to releasably lock the gates 180, 182 in the expanded position. FIG. 9 shows a portion of a support frame 110*a* cut out to show one of the locks 130. In the illustrated embodiment, each of the opposite ends 194, 196 of each gate 180, 182 defines a through bore 150. Each lock 130 includes a housing 134 disposed on a cooperating gate end 194, 196 proximate the through bore 150. A pin 132 is also included which is spring-biased to extend through the through bore 150. Each overlap extension 195 defines a cooperating through opening 144 which is configured to substantially align with the through bore 150 of the cooperating gate end 194, 196 when the gates 180, 182 are rotated to the side-by-side expanded position. In this configuration, extension of the pin 132 through a through bore 150 and cooperating opening 144 serves to lock each respective gate 180, 182 in the side-by-side expanded position.

A ring 136 is secured to each spring-biased pin 132 to maintain the pin 132 within its housing 134 against the bias of the spring, and to allow for selective withdrawal of the pin 132 from the through bore 150. As shown in FIG. 9, the housing 134 is provided with a plurality of slots 138 adapted to receive the ring 136 and allow the pin 132 to slide from within the housing 134 through the through bore 150. The pin 132 is released from the through bore 150 by withdrawing the ring 136 from the slots 138 and turning the ring 136 until the ring 136 engages a plurality of indents 146 of the housing 134, thereby allowing the pin 132 to remain retracted from the through bore 150. In this manner, the lock 130 is selectively lockable and unlockable so as to allow the first and second frame portions 106, 108 to be selectively secured in the collapsed position. Of course, those skilled in the art will recognize numerous devices and configurations suitable for selectively locking and unlocking the first and second frame portions 106, 108 in the collapsed position, including but not limited to fasteners, frictional engagement, and the like, and such devices and configurations may be used without departing from the spirit and scope of the present invention.

From the foregoing, it will be understood that first, second, third, and fourth expandable members 110, 112, 114, and 116, can be any expandable or expansion member for collapsing and expanding the truss 100. For example, in one embodiment, a single gate is pivotally attached to one of the frame portions and pivots inwardly or outwardly when the frame is collapsed. Those skilled in the art will recognize that other expandable/expansion members can be employed without departing from the spirit and scope of the present invention, including telescoping members, twist locking cylinders, pivotally interconnected struts, springs, and the like.

Figure 10:
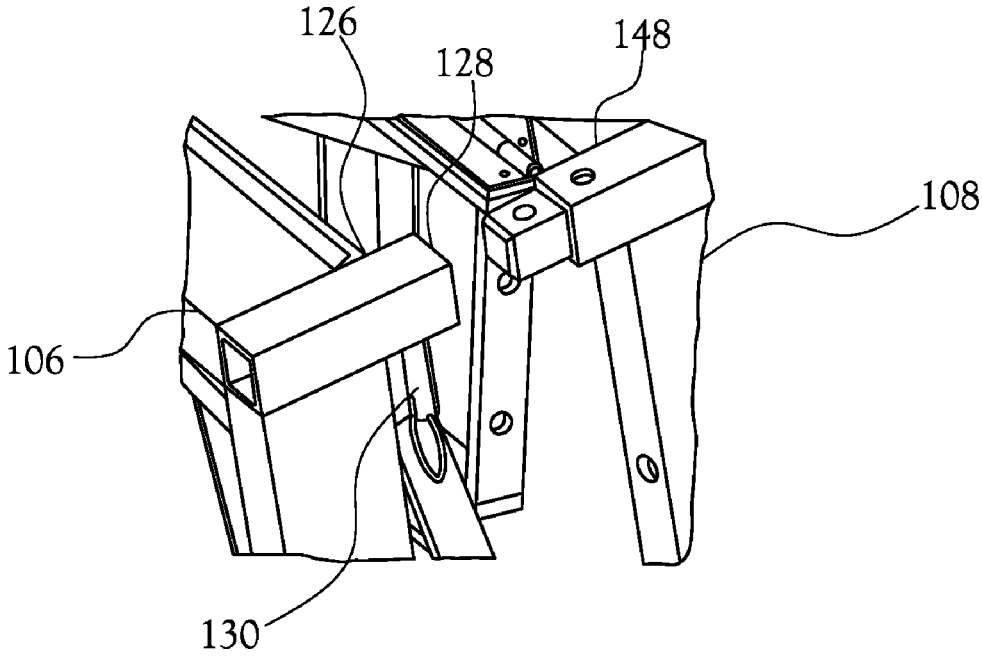
FIG. 10 is a partial perspective view of a portion of the truss of FIG. 4, showing the hollow piece, post, and lock portions of the truss, with the hollow piece and post separated and expanded from one another.
Figure 11:
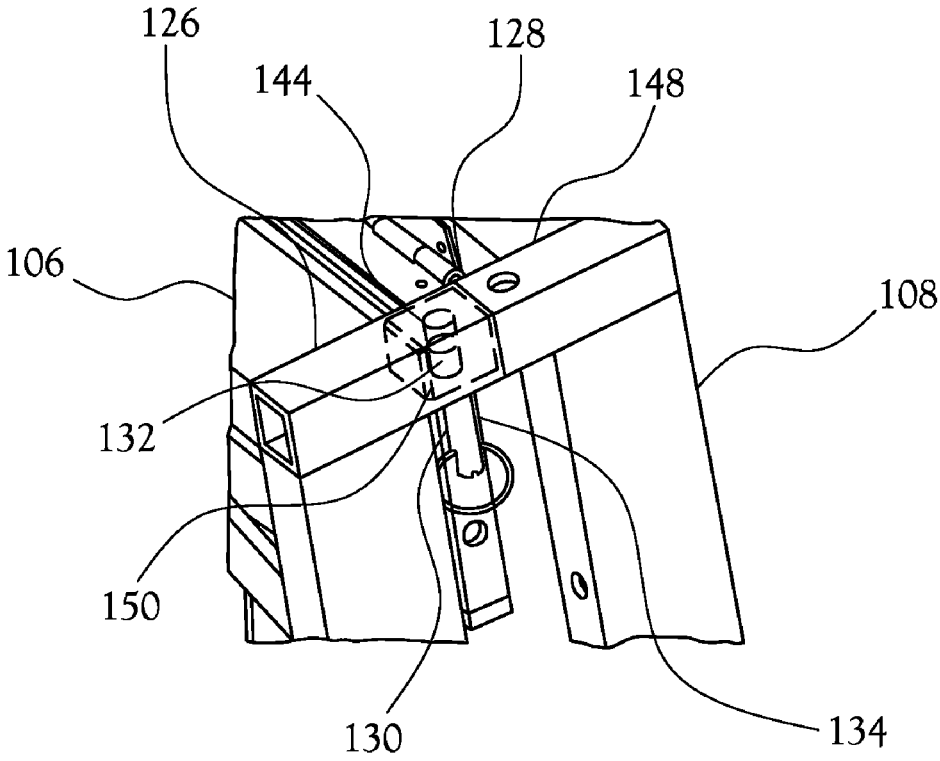
FIG. 11 is a partial perspective view of a portion of the truss of FIG. 4, showing the hollow piece, post, and lock portions of the truss, with the post received within the hollow piece.

In the embodiment of FIG. 4, at least one lock 130 is disposed between the first frame 106 and the second frame 108 to selectively lock the first frame 106 in the collapsed position proximate the second frame 108. As shown in FIGS. 10 and 11, a hollow piece 126 is disposed at each corner of the first frame 106 and is configured to extend cantilevered toward the second frame 108. Each cantilevered end 128 of each hollow piece 126 is provided with a lock 130. For each hollow piece 126 disposed about the first frame 106, a post 148 is provided to extend from the second frame 108 toward the first frame 106 in such a configuration that each post 148 is adapted to be received within and engage a cooperating hollow piece 126. Each lock 130 mounted on each hollow piece 126 is adapted to engage a cooperating post 148 to selectively join the post 148 to the hollow piece 126, thereby securing the second frame 108 proximate the first frame 106 when the truss 100 is in the collapsed position.

As shown in FIGS. 10 and 11, each hollow piece 126 defines a through bore 150. As discussed above, each lock 130 includes a housing 134 disposed on a cooperating through bore 150, and each lock 130 further includes a pin 132 which is spring-biased to extend through the through bore 150. Each post 148 defines a cooperating opening 144 which is configured to substantially align with the through bore 150 of the cooperating hollow piece 126 when the post 148 is received within the hollow piece 126 (see FIG. 11). In this embodiment, selective extension of the pin 132 through a through bore 150 and cooperating opening 144 serves to selectively lock each respective post 148 within each cooperating hollow piece 126. Of course, those skilled in the art will recognize numerous devices and configurations suitable for selectively locking and unlocking the first and second frame portions 106, 108 in the collapsed position, including but not limited to fasteners and frictional engagement, and such devices and configurations may be used without departing from the spirit and scope of the present invention.

Referring to FIG. 1, each protection member 102 includes generally a panel 172 fabricated from a ballistic material. The panel 172 is defined by at least one layer of substantially rigid ballistic material, such as steel, ballistic ceramic, glass-ceramic, ballistic polymer, metallic armor foam, or other such armor material suitable for disrupting a ballistic projectile. In one embodiment, the panel 172 is fabricated from multiple layers of substantially rigid ballistic material. In other embodiments, the panel 172 includes at least one layer of substantially rigid ballistic material and at least one layer of substantially flexible ballistic material, such as a fragmentation blanket, glass fabric, flexible polymer, or other material capable of providing additional disruption to a ballistic projectile. In other embodiments, the panel 172 also includes at least one layer of chemically resistant material, such as a polymer or other material capable of withstanding a chemical attack.

Each panel 172 is adapted to be releasably secured to the truss 100 to form the armored wall system 10. In the illustrated embodiment, each panel 172 is substantially rectangular in shape and defines beveled sections 173 along two adjacent edges of the panel 172 and flat sections 175 along the remaining two edges of the panel 172. In this embodiment, each beveled section 173 of a panel 172 is adapted to overlap with the corresponding flat edge 175 of an adjacent panel 172, such that the seams between adjacent panels 172 are substantially covered and reinforced by the beveled sections 173. Of course, those skilled in the art will recognize other suitable configurations to allow for reinforcement of the seams between adjacent panels 172, and such other configurations may be used without departing from the spirit and scope of the present invention. To this extent, interlocking edges of adjacent panels 172 and simple frictional engagement of adjacent panels 172 are contemplated.

Figure 15:
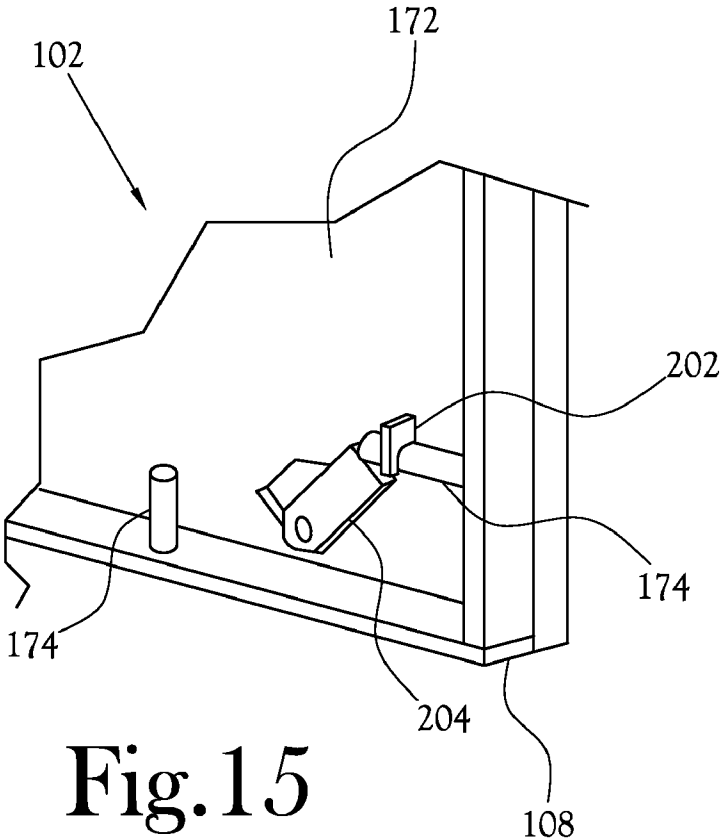
FIG. 15 is a partial perspective view of the holding member of FIG. 14, showing the connector of a protection member engaging the holding member in an abutted position.
Figure 14:
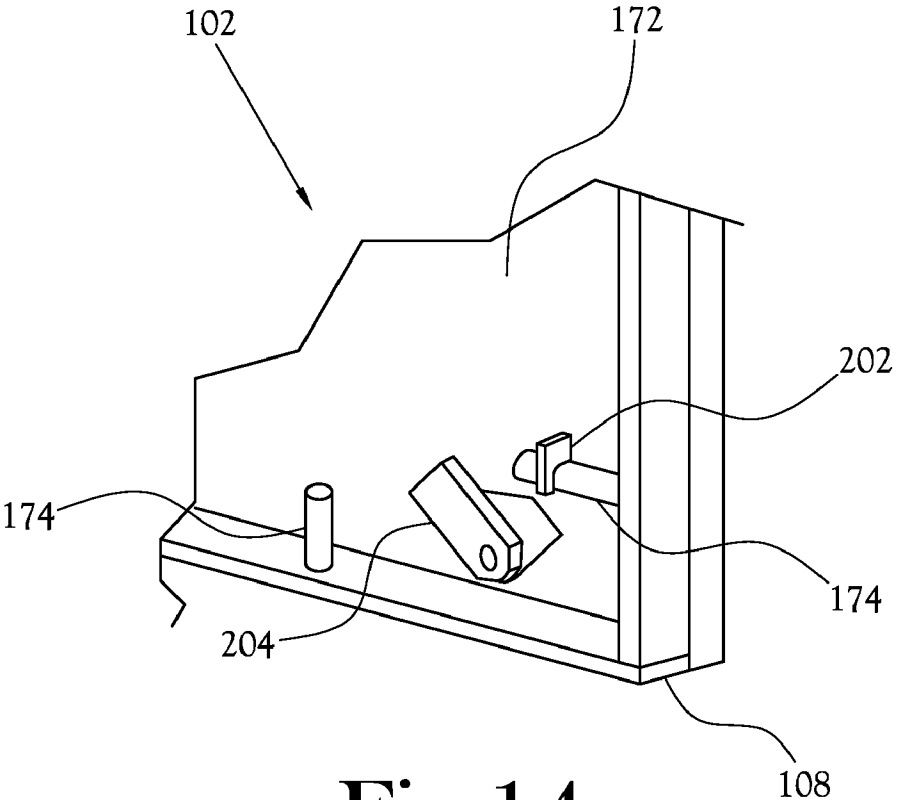
FIG. 14 is a partial perspective view of a holding member of the truss illustrated in FIG. 2, showing the connector of a protection member engaging the holding member in a free position.

Referring to FIG. 2, a plurality of holding members 174 are provided on at least one of the first and second frames 106, 108 for releasably supporting a protection member 102. As shown in FIGS. 14 and 15, each protection member 102 includes suitable connectors 202 disposed on at least one planar surface of the panel 172 to allow the panel 172 to be releasably secured to at least a portion of the holding members 174 of one of the first and second frames 106, 108. In the illustrated embodiment, a plurality of hooks 202 are disposed along one surface of the panel 172. The hooks 202 are configured to engage at least one of the holding members 174 to secure the protection member 102 to one of the first and second frames 106, 108. An elongated pivotal member 204 is provided proximate at least one hook 202. As shown in FIGS. 14 and 15, the pivotal member 204 is configured to allow for selective rotation along the panel 172 between a free position (FIG. 14) and an abutted position (FIG. 15). Upon engagement of the hooks 202 with cooperating holding members 174, each pivotal member 204 is selectively positionable to the abutted position, whereby the rotatable member provides a stop to prevent a cooperating holding member 174 from disengaging a cooperating hook 202. Thus, the rotatable member 204 provides a means to selectively lock and unlock the releasable engagement of the protection member 102 to the truss 100.

In the illustrated embodiment of FIGS. 1 and 2, the protection members 174 are sized to substantially cover one partition of one of the first and second frames 106, 108. Multiple holding members 174 are located within each partition of the first and second frames 106, 108. In this embodiment, cooperating holding members 174 located within one partition support one protection member 102, while cooperating holding members 174 located within another partition support at least one other protection member 102. However, those skilled in the art will recognize that the size of the protection members 174 may vary without departing from the spirit and scope of the present invention. To this extent, in another embodiment a portion of the holding members 174 disposed within one partition cooperate to support one protection member 102, while another portion of the holding members 174 disposed within the partition cooperate to support at least one other protection member 102. In still another embodiment, all holding members 174 provided on one of the first and second frames 106, 108 cooperate to support a single protection member 102.

Figure 13:
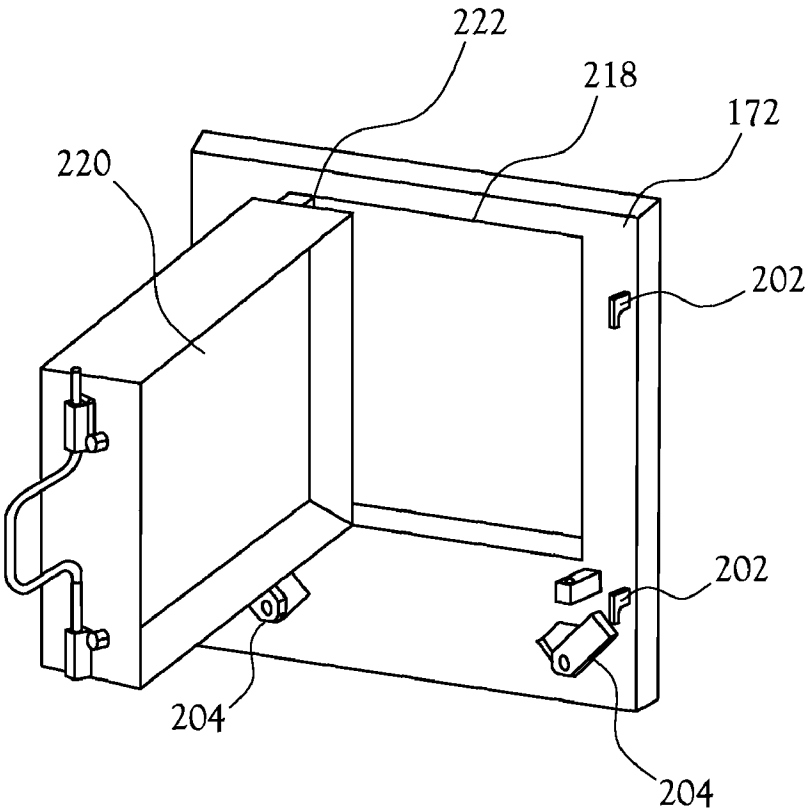
FIG. 13 is a partial perspective view of a protection member of one embodiment of the present invention, showing the window in an open position.
Figure 12:
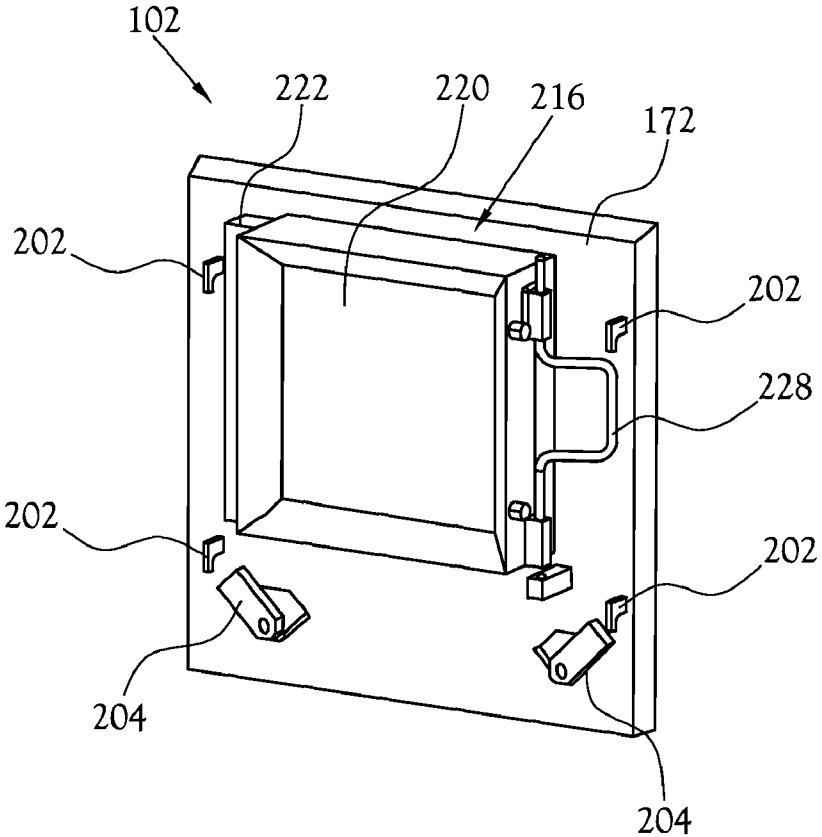
FIG. 12 is a partial perspective view of a protection member of one embodiment of the present invention, showing the window in a closed position.

Referring to FIGS. 12 and 13, in one embodiment, at least one protection member 102 includes a window 216. The window 216 is sized and shaped to allow a user at least visible access to a portion of the environment beyond the panel 172. In the illustrated embodiment, the window 216 includes a portal 218 defined by the panel 172. A window pane 220 is selectively securable within the portal to allow a user selective access through the portal 218. In the illustrated embodiment, the window pane 220 is hinged along one edge 222 of the portal 218, and a suitable fastener 228 is provided to secure the window pane 220 in a closed position within the portal 218, such that the window 216 is selectively openable and closable. In one embodiment, the window pane 220 is fabricated from a ballistic material substantially similar to the panel 172 such as for example, steel, ballistic ceramic, ballistic polymer, or other such material. In another embodiment, the window pane 220 is fabricated from a transparent ballistic armor, such as glass-ceramic, transparent ballistic polymer, borosilicate glass, tempered glass, or other such transparent material. In more discreet embodiments, a window pane 220 of transparent ballistic armor is fixed within the portal 218, while an opaque selectively openable and closable door is provided to selectively cover the window pane 220 and to allow selective observation through the fixed, transparent, ballistic armor window pane.

Figure 20:
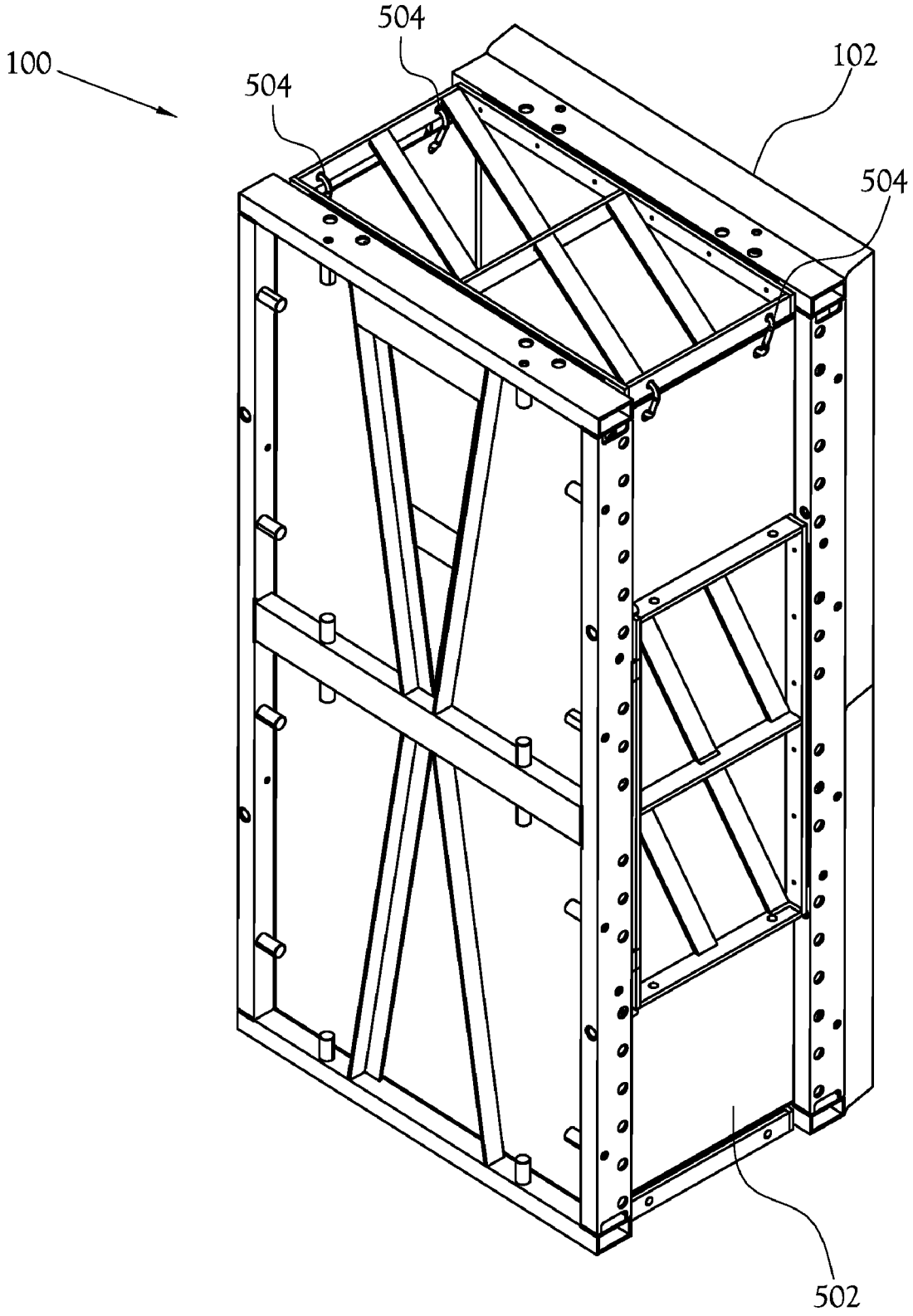
FIG. 20 is a perspective view showing another embodiment of the portable protection system.
Figure 21:
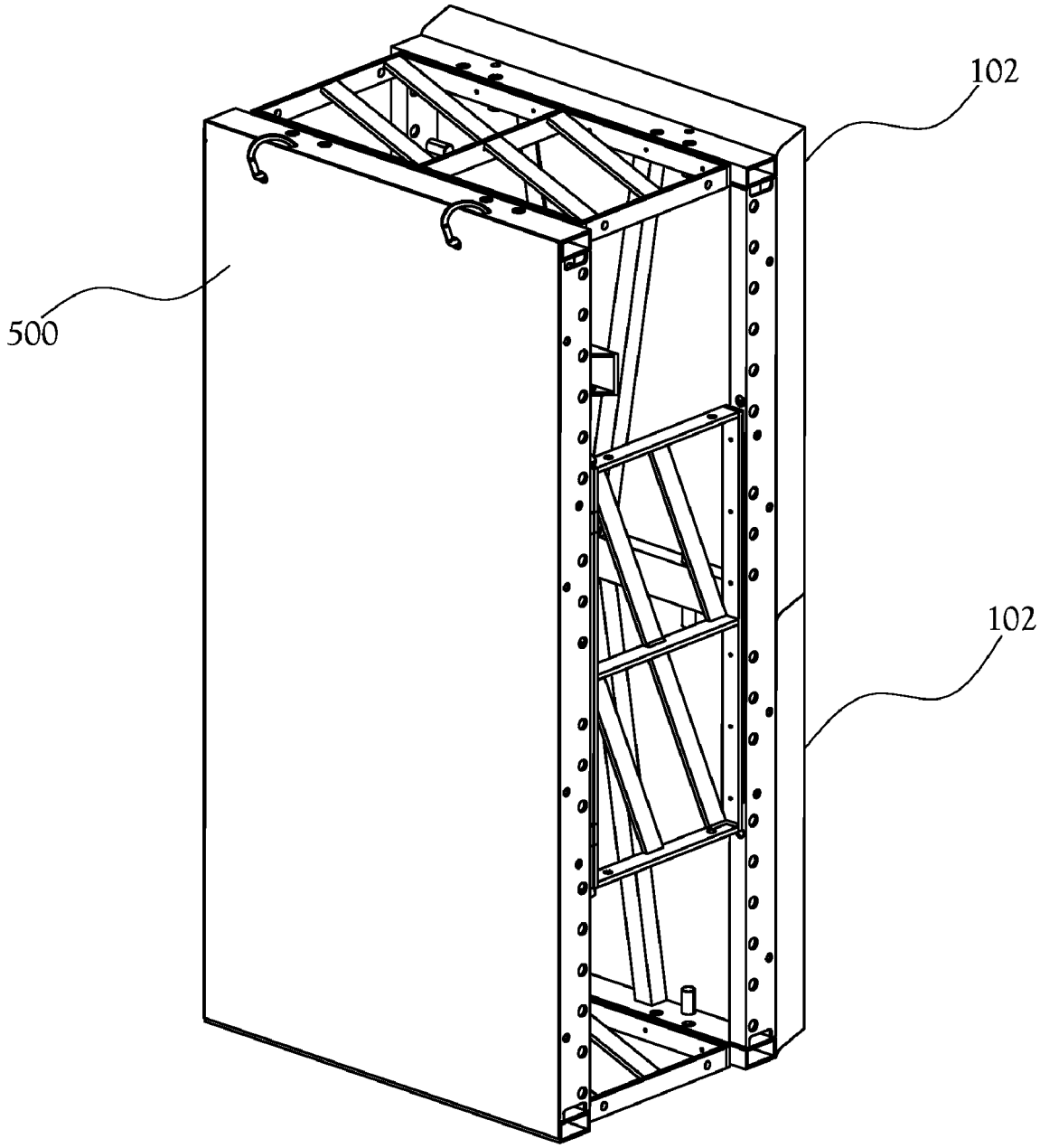
FIG. 21 is a perspective view showing the truss of FIG. 2 and including a flexible armor blanket.

Those skilled in the art will recognize different combinations and types of protection members 102 which may be combined and mounted on the front or back of the truss 100, or both, depending on the threat level. For example, if the threat level is small arms, a ceramic tile panel mounted on the front of the truss 100 may be sufficient. Referring to FIG. 21, for heavier arms threat, multiple-layered protection members 102 can be mounted on the front of the truss 100 with a fragmentation blanket 500 mounted on the back. In several more discreet embodiments, such as the embodiment illustrated in FIG. 20 the interior space of the truss 100 is adapted to contain a dispersive material, such as sand bags or other such containers filled with concrete, rocks, water, gels, thickening fluids, or other such dispersive materials. For example, in the embodiment shown in FIG. 20, at least one sand bag 502 is provided within the interior of the truss 100. Additionally, at least one hanger 504 is provided for hanging at least one sand bag in an elevated position within the truss 100.

Figure 16:
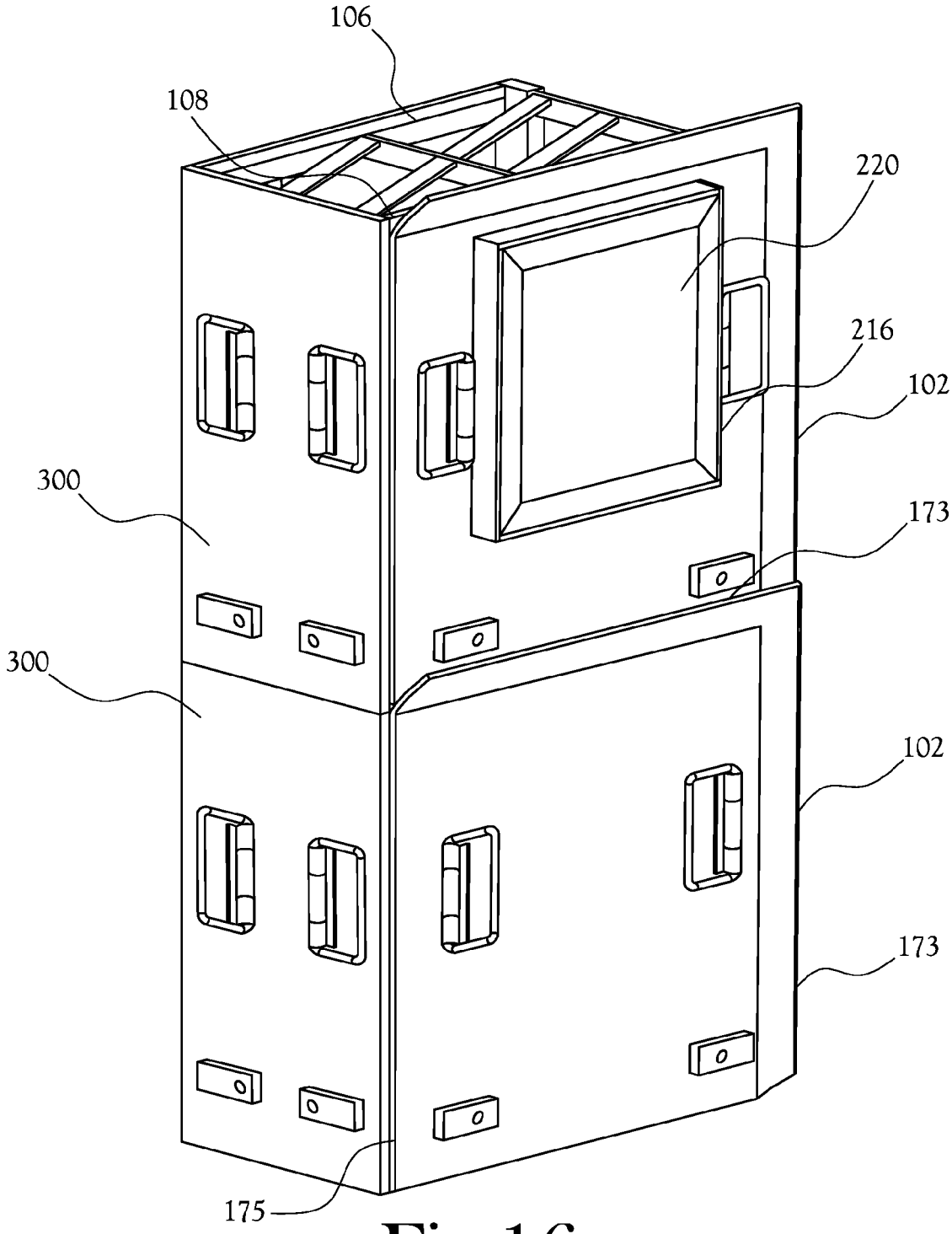
FIG. 16 is a perspective view showing another embodiment of the portable protection system.

In several embodiments, additional holding members 174 are provided on each of the second and third opposing inner surfaces 162, 164, 166, 168 of the first and second frames 106, 108. As shown in FIG. 16, these additional holding members 174 are adapted to releasably support at least one end protection member 300 between the first and second frames 106, 108. The end protection member 300 serves to enclose a portion of the interior of the truss 100 between the first and second wall frames 106, 108 to provide additional ballistic protection to the interior of the truss 100, as well as to provide additional structural support to the system 10. However, those skilled in the art will recognize that inclusion of the end protection members 300 is not necessary to accomplish the present invention.

Figure 17:
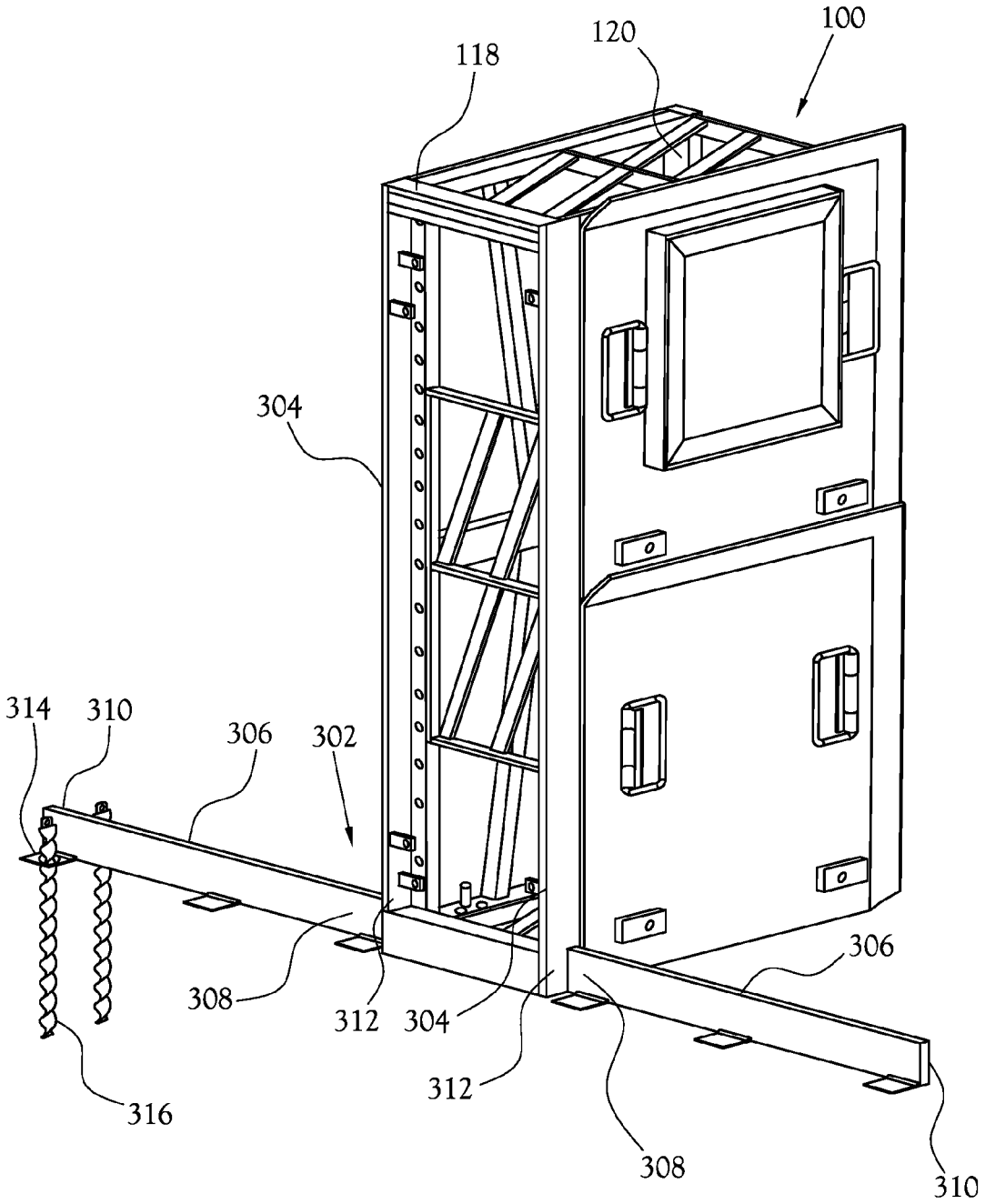
FIG. 17 is a perspective view showing the embodiment of FIG. 16 and including a stanchion.

FIG. 17 illustrates an additional feature of several embodiments of the present invention. As shown in FIG. 17, a stanchion 302 is provided to support the truss 100 in a substantially upright position. The stanchion includes a substantially rigid upright beam 304 adapted to be secured to the truss 100 along at least one of the first and second side members 118, 120 of the wall frames 106, 108. A floor beam 306 is provided having a proximal end 308 fixed to the upright beam 304 and a distal end 310 which extends from the upright beam 304 toward a floor surface, such as the ground or other floor surface. The floor beam 306 engages the floor surface to secure the upright beam 304 in a substantially upright configuration proximate the floor surface. In the illustrated embodiment, the proximal end 308 of the floor beam 306 is secured to a bottom end 312 of the upright beam 304, thereby allowing the floor beam 306 to extend orthogonally from the upright beam 304 along the floor surface to support the upright beam 304 in the upright configuration. However, it will be understood by those skilled in the art that an orthogonal relationship between the upright beam 304 and the floor beam 306 is not necessary to accomplish the present invention. To this extent, in another embodiment, the proximal end 308 of the floor beam 306 is secured to an upper portion of the upright beam 304, and the floor beam 306 extends downward at an acute angle to the upright beam 304 to contact the floor surface.

As shown in FIG. 17, the distal end 310 of the floor beam 306 defines a through opening 314. A stake 316 is adapted to be received by the through opening 314 and driven into the floor surface in order to secure the stanchion in place proximate the floor surface. Of course, those skilled in the art will recognize other connectors suitable for securing the stanchion 302 proximate a floor surface, and such connectors may be used without departing from the spirit and scope of the present invention.

Each truss 100 includes a means for engaging an adjacent truss 100. For example, in the embodiment of FIG. 2, the first and second wall frames 106, 108 are provided with a plurality of holes 508. Each hole 508 is configured to substantially align with a corresponding hole of an adjacent truss 100. When multiple trusses are positioned in a side-by-side configuration such that cooperating holes 508 are brought into substantial alignment, each hole 508 is adapted to receive a standard connector, such as a bolt, screw, pin, or other suitable connector.

In the embodiment of FIG. 4, the connector 206 includes a bracket 208 defining an opening 210 configured to align with a pin 510 disposed on an adjacent truss 100. The bracket 208 extends generally outwardly from the truss 100 away from the support frames 110, 112, 114, 116. Upon positioning a plurality of trusses 100 adjacent one another such that brackets 208 and corresponding pins 510 of adjoining trusses 100 are brought into alignment, the pins 510 are adapted to be received within the openings 210 to secure the trusses 100 in an adjacent configuration. In the illustrated embodiment, the connectors 206 are disposed on the support frames 110, 112, 114, 116, however, it will be understood that the connectors 206 can be alternatively provided on the wall frame portions 106, 108 of the truss 100 without departing from the spirit and scope of the present invention. Furthermore, it will be understood that, as alternatives to brackets 208 and pins 510, any known connectors, such as bolts, hooks, clips, latches, ties, and the like, can be used to gang multiple trusses 100 together.

Figure 18:
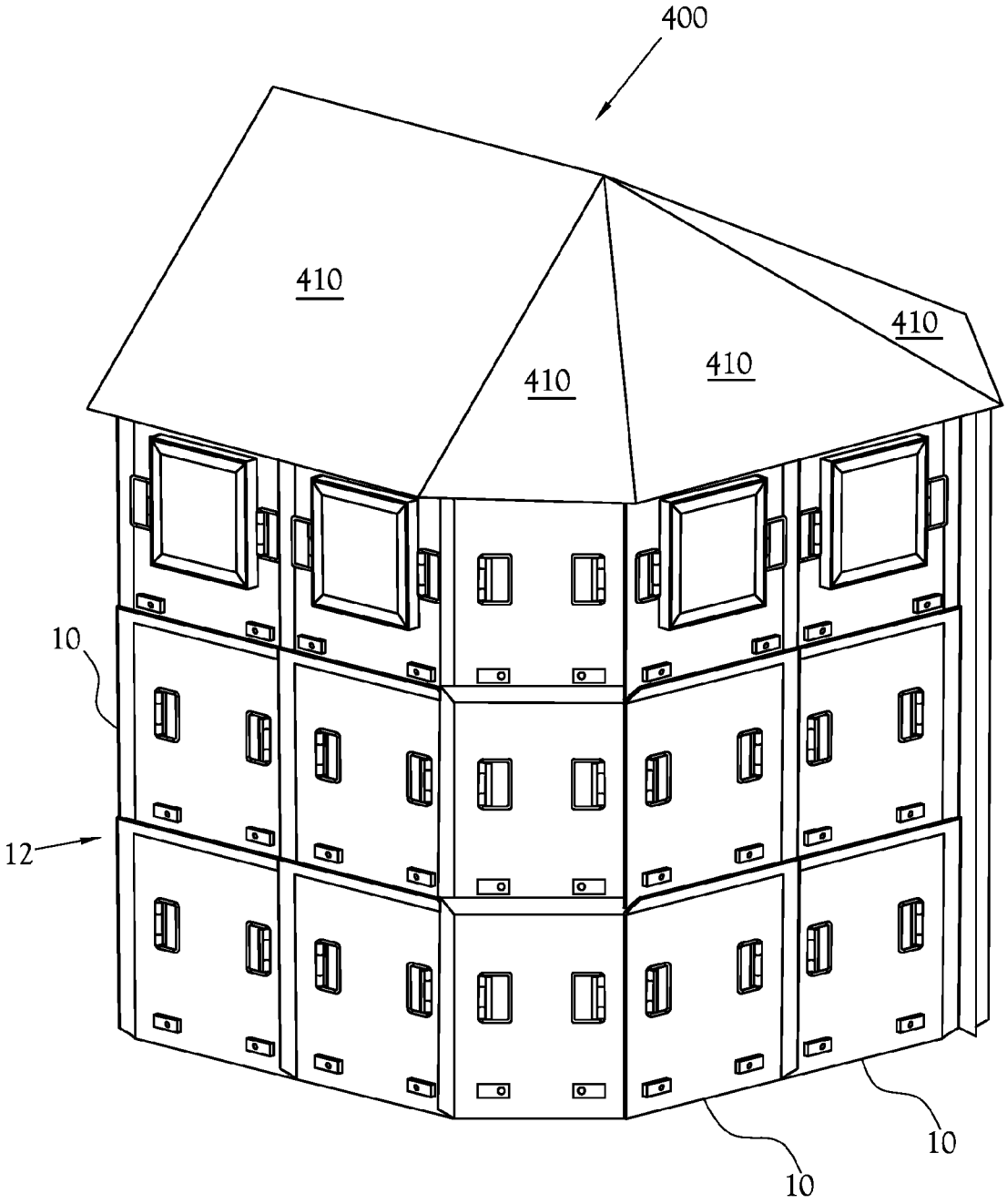
FIG. 18 is a perspective view of a protection wall formed from multiple portable protection systems and showing a roof structure.

Those skilled in the art will recognize that multiple trusses 100 may be set up in a side-by-side configuration, with each side, top, and bottom of a truss 100 being releasably connectable with another truss 100 to form a protection wall 12 of system 10. The ganging together of multiple frames 100 in a side-by-side or end-to-end configuration allows the portable protection system to be formed in numerous modular configurations to meet a particular need. For example, FIG. 18 illustrates a protection wall 12 formed by adjoining multiple systems 10 to form a three-sided structure. In the embodiment shown in FIG. 18, a roof structure 400 is provided to cover the interior of the protection wall 12 and provide ballistic protection from overhead ballistic threats.

Figure 19:
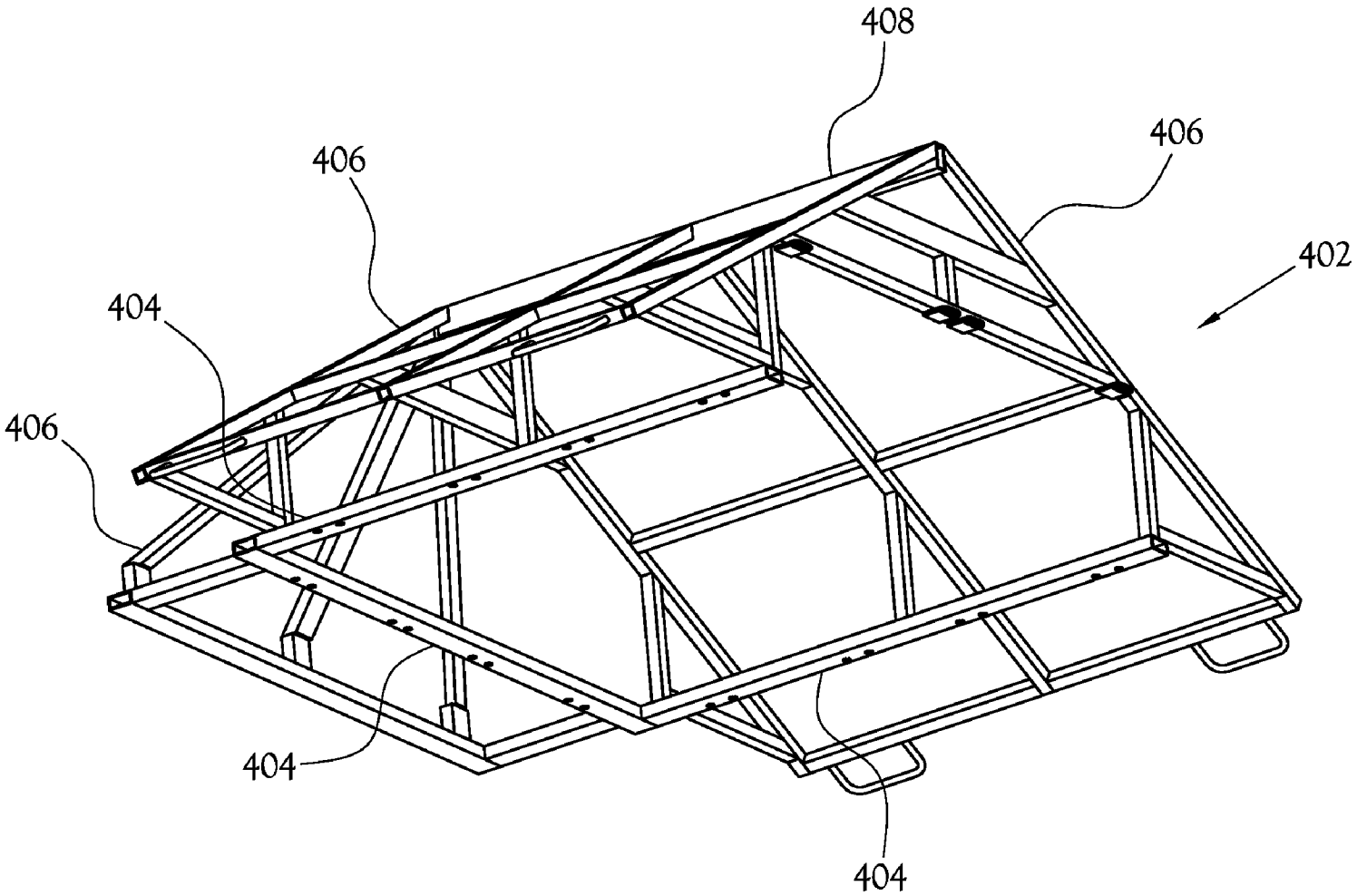
FIG. 19 is a perspective view showing the roof truss of the roof structure of FIG. 18.

As shown in FIGS. 18 and 19, the roof structure 400 includes a roof truss 402 having mounting rails 404 adapted to be secured to at least one of the first and second end members 122, 124 of at least one truss 100. The mounting rails 404 carry and support a plurality of roof frames 406 which are secured to the mounting rails 404 in an angled configuration and meet along a central gable 408. The plurality of roof protection members 410 are collectively shaped to form a substantially enclosed roof surface. As discussed above with respect to the protection members 102, the roof protection members 410 are provided with suitable connectors to releasably engage the roof frames 406 in order to releasably mount the roof protection members 410 to the roof frames 406.

The system 10 is adapted to be used for various protection needs including ballistic, blast, and chemical protection. Any number of trusses 100 can be ganged together in various wall configurations to meet any need. Each truss 100 is portable, lightweight, and self-standing. Also, each truss 100 can be rapidly assembled from a collapsed position (FIG. 3) to an expanded position (FIG. 2), and disassembled for storage and transportation. The portable protection system 10 of the present invention can be easily moved and quickly set up in any location, and the protection members 102 can be adjusted or changed to meet any threat level. With the above-described system 10, protection walls can be rapidly and easily set up in any configuration with minimal need for tools. The system 10 can also be rapidly disassembled by selectively disconnecting the connectors 206 of the protection members 102, removing the protection members 102 from each frame, and collapsing the truss 100. Given the lightweight nature of each truss 100, the frames can be easily moved to another location to set up another protection wall.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicants general inventive concept.

The invention claimed is:

1. A portable protection device comprising:

a selectively collapsible self-standing truss, comprising at least one connector for releasably connecting said collapsible truss to an adjacent collapsible truss; and at least one protection member having at least one ballistic armor layer for disrupting a projectile, said at least one protection member being carried by said truss, said at least one protection member being selectively releasable from said truss, said at least one protection member comprising;

a ballistic armor panel; and a plurality of connectors adapted to releasable engage said truss to secure said ballistic armor panel to said truss, wherein each of said connectors comprises:

a hook disposed along a surface of said ballistic armor panel, said hook being adapted to engage said truss; and a pivotal member disposed along said surface of said ballistic armor panel proximate said hook, said pivotal member being configured to allow for selective rotation along said ballistic armor panel from a first position to a second position, whereby said pivotal member prevents disengagement of said hook from said truss when rotated to said second position.

2. The portable protection device of claim 1, said at least one protection member defining at least one beveled edge adapted to overlap at least one edge of an adjacent protection member.

3. The portable protection device of claim 1, said truss further comprising:

a first frame and a second frame, at least one of said first and second frames being adapted to be selectively secured to said at least one protection member; and a plurality of support member extending between said first and second frames and supporting said first frame in spaced apart relation to said second frame, said support members being selectively movable between a collapsed position and an expanded position.

4. The portable protection device of claim 3, wherein said plurality of support members is defined by a plurality of selectively expandable members extending between said first and second frames, said selectively expandable members being configured to allow said first frame to be selectively repositioned proximate said second frame to allow said truss to be selectively collapsed and selectively expanded.

5. The portable protection device of claim 3, wherein each of said plurality of support members is selectively releasable from at least one of said first and second frames.

6. The portable protection device of claim 1, said at least one protection member further comprising at least one layer of substantially rigid ballistic material and at least one layer of substantially flexible ballistic material.

7. The portable protection device of claim 6, said at least one layer of substantially rigid ballistic material being selected from the group consisting of steel, ballistic ceramic, glass-ceramic, ballistic polymer, and metallic armor foam.

8. The portable protection device of claim 6, said at least one layer of substantially flexible ballistic material being selected from the group consisting of fragmentation blanket material, glass fabric, and flexible polymer.

9. The portable protection device of claim 1, said at least one protection member comprising:

a ballistic armor panel; and a portable defined by said ballistic armor panel; and a window secured within said portal.

10. The portable protection device of claim 9, said window being releasably secured within said portal.

11. The portable protection device of claim 10, said window being hinged to said ballistic armor panel proximate said portal such that said window is selectively openable and closable, said window including a latch for releasably securing said window within said portal.

12. The portable protection device of claim 1 further including a stanchion releasably secured to said truss, said stanchion being adapted to support said truss in an upright position.

13. The portable protection device of claim 12, said stanchion comprising:

an upright member releasably secured to said truss; and a floor member having a proximal end and a distal end, said proximal end being joined to said upright member and said distal end extending outward from said truss toward a floor surface when said truss is supported in said upright position.

14. The portable protection device of claim 1 further comprising a container for holding a dispersive material, said container being disposed within said truss.

15. The portable protection device of claim 14, said dispersive material being selected from the group consisting of sand, concrete, rocks, water, gels and thickening fluids.

16. The portable device of claim 1 further comprising a flexible armor blanket carried by said truss, said flexible armor blanket being adapted to control fragmentation of a disrupted projectile.

17. The portable protection device of claim 1 further comprising:

a roof structure having at least one mounting rail adapted to be secured to said truss, said roof structure further having at least one roof frame carried by said at least one mounting rail; and at least one roof protection member releasably secured to at least one of said plurality of roof frames, said at least one protection member having at least one ballistic armor layer for disrupting a projectile.

18. A portable protection device comprising:

a selectively collapsible truss, comprising:

a first wall frame;

a second wall frame;

a plurality of support frames movable between a collapsed position and an expanded position, said plurality of support frames extend between said first and second wall frames and supporting said first wall frame in spaced apart relation to said second wall frame, when said support frames are in said expanded position;

at least one connector disposed on at least one of said first wall frame or second wall frame for releasably connecting said collapsible truss to an adjacent collapsible truss; and a plurality of holding members for releasably securing to said first or second wall frames at least one protection member having at least one ballistic armor layer for disrupting a projectile, wherein said at least one protection member comprising:

at least one hook disposed along a first surface of said protection member, said at least one hook being adapted to engage said holding member of said collapsible truss; and at least one pivotal member disposed along said first surface of said protection member proximate said hook, said pivotal member being configured to allow for selective rotation along said protection member from a first position to a second position, whereby said pivotal member prevents disengagement of said hook from said holding member when rotated to said second position.

19. The portable protection device of claim 18, wherein said at least one pivotal member engages said holding member from the opposite direction of said hook when said at least one pivotal member is in the said second position.

20. The portable protection device of claim 18, wherein said plurality of support frames are rotatably connected to at least one of said first and second wall frames and movable between said collapsed position and said expanded position, wherein in the said collapsed position said support frames are substantially parallel to said connected first or second wall frames, and wherein in the expanded position said support frames are substantially perpendicular to said connected first or second wall frames.

* * * * *